US010525714B2

(12) United States Patent
Alvarez et al.

(10) Patent No.: US 10,525,714 B2
(45) Date of Patent: Jan. 7, 2020

(54) PRINTING DEVICE AND SUPPORT MEMBER FOR PRINTING DEVICE

(71) Applicant: HEWLETT-PACKARD DEVELOPMENT COMPANY, L.P., Houston, TX (US)

(72) Inventors: Jose Antonio Alvarez, Sant Cugat del Valles (ES); Carlos Chover, Sant Cugat del Valles (ES); Emilio Angulo, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/546,214

(22) PCT Filed: Apr. 17, 2015

(86) PCT No.: PCT/EP2015/058445

§ 371 (c)(1),
(2) Date: Jul. 25, 2017

(87) PCT Pub. No.: WO2016/165781

PCT Pub. Date: Oct. 20, 2016

(65) Prior Publication Data

US 2018/0022102 A1 Jan. 25, 2018

(51) Int. Cl.

| | |
|---|---|
| ***B41J 2/17*** | (2006.01) |
| ***B41J 2/175*** | (2006.01) |
| ***B41J 2/21*** | (2006.01) |

(52) U.S. Cl.

CPC ..... *B41J 2/17523* (2013.01); *B41J 2/21* (2013.01)

(58) Field of Classification Search

None

See application file for complete search history.

(56) References Cited

U.S. PATENT DOCUMENTS

| | | | | |
|---|---|---|---|---|
| 4,929,963 | A | 5/1990 | Balazar | |
| 5,418,557 | A | 5/1995 | Pullen | |
| 6,024,441 | A * | 2/2000 | Nishimoto | B41J 2/175 347/85 |
| 6,076,920 | A * | 6/2000 | Zapata | B41J 2/17506 347/85 |

(Continued)

FOREIGN PATENT DOCUMENTS

| | | |
|---|---|---|
| CN | 1227794 | 9/1999 |
| CN | 1396865 | 2/2003 |

(Continued)

*Primary Examiner* — Erica S Lin

(74) *Attorney, Agent, or Firm* — HP Inc. Patent Department

(57) ABSTRACT

Provided is a printing apparatus having a support member with a printhead slot, a first tubing to provide a first printing fluid, and a second tubing to provide a second printing fluid. An end portion of the first tubing is arranged in an active position to provide the first printing fluid to a printhead in the printhead slot. An end portion of the second tubing is arranged in a standby position to not provide the second printing fluid to a printhead. A mechanical structure to which the end portion of the first tubing is attached allows to remove the end portion of the first tubing from the active position and to arrange the end portion of the second tubing in the active position.

13 Claims, 4 Drawing Sheets

(56) References Cited

U.S. PATENT DOCUMENTS

| | | | | |
|---|---|---|---|---|
| 6,799,840 | B2 * | 10/2004 | Inamura | B41J 2/17509 347/85 |
| 6,908,178 | B2 | 6/2005 | Jeanmaire | |
| 2012/0042971 | A1 * | 2/2012 | Py | A61M 39/10 137/798 |

FOREIGN PATENT DOCUMENTS

| | | |
|---|---|---|
| CN | 1121322 | 9/2003 |
| DE | 3932462 | 4/1991 |
| EP | 0883283 | 12/1998 |
| EP | 1091563 | 4/2004 |

* cited by examiner

PRINTING DEVICE AND SUPPORT MEMBER FOR PRINTING DEVICE

Printing a printing fluid on a printing medium may involve providing the printing fluid, e.g., an ink, from a printing fluid reservoir such as a printing fluid cartridge or a printing fluid tank to a printhead. When a set of printing fluids in a printing apparatus is to be changed, e.g., when a printing fluid is to be replaced with a printing fluid of another color to achieve a particular color gamut or when the number of printing fluids of different colors is to be reduced to increase printing speed by having several printheads printing the same ink, the involved printing fluid tanks, printheads and tubing may have to be replaced to avoid mixing of printing fluids.

BRIEF DESCRIPTION OF DRAWINGS

The following detailed description refers to the appended drawings in which.

DETAILED DESCRIPTION

Figure 1A:
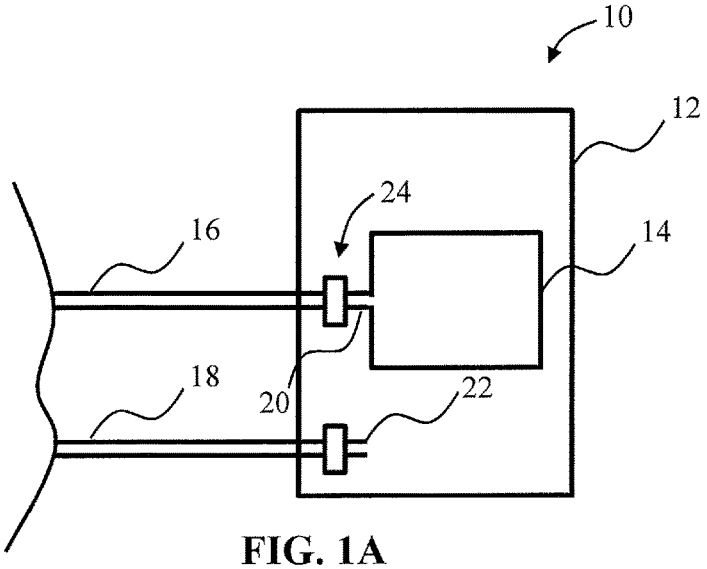
FIGS. 1A and 1B show schematic cross-sectional views of examples of elements of a printing apparatus.
Figure 1B:
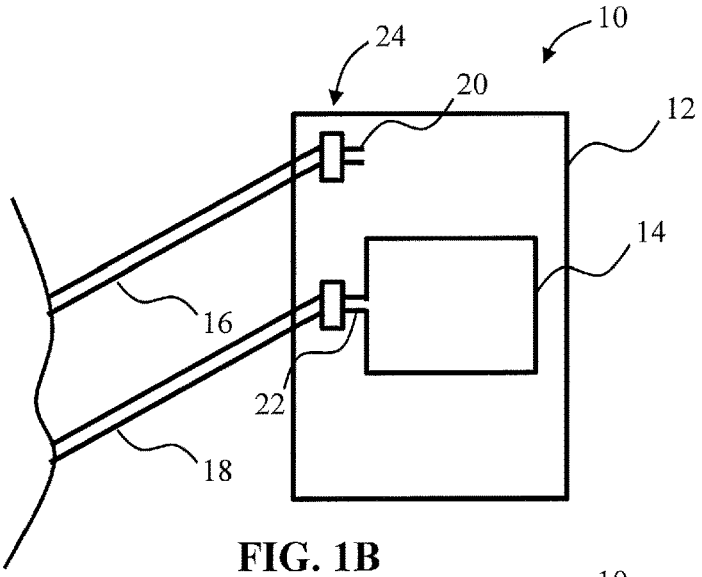

As shown in FIGS. 1A and 1B, a printing apparatus 10 (or printing device) may comprise a support member 12 having a printhead slot 14. In printing operation, a printhead (not shown) such as, for example, an inkjet printhead may be mounted to the printhead slot 14.

The printing apparatus 10 may further comprise a first tubing 16 and a second tubing 18. The first tubing 16 may be intended to receive a first printing fluid. The second tubing 18 may be intended to receive a second printing fluid. To avoid that the first printing fluid and the second printing fluid are mixed, for example, if the first printing fluid and the second printing fluid are inks of different colors or different components, the first tubing 16 and the second tubing 18 may be separated. In particular, the first tubing 16 and the second tubing 18 may have no fluid connection or the first tubing 16 and the second tubing 18 may be connected by a separable fluid interconnect or a gate valve to allow separation of a printing fluid in the first tubing 16 and a printing fluid in the second tubing 18.

Although one printhead slot 14 is shown in FIGS. 1A and 1B, the disclosure is not limited thereto and the support member 12 may comprise additional printhead slots. For example, the printing apparatus 10 may comprise four printhead slots for CYMK printing. However, although the printing apparatus 10 may comprise four printhead slots for CYMK printing, the disclosure is not limited to CYMK printing. In particular, the printing apparatus 10 may comprise more than four printhead slots to allow for single-pass printing and/or to allow for enlarged color gamut and/or to allow for pre or post treatment fluids or less than four printhead slots when a reduced color gamut is desired.

In case of additional printhead slots, the printing apparatus 10 may be provided with additional tubing for each additional printhead slot. In particular, each or some of the additional tubing may comprise a first tubing and a second tubing as described above. In addition, the support member 12 may be a printhead carriage that is movable relative to a frame (not shown) of the printing apparatus 10 to allow for scan printing. Furthermore, the support member 12 may span a printing width of the printing apparatus 10 to allow for single-pass printing.

The first tubing 16 may comprise an end portion 20. As shown in FIG. 1A, the end portion 20 of the first tubing 16 may be arranged in an active position. The active position may be a position in which a printing fluid may be delivered via the end portion 20 of the first tubing 16 to a printhead mounted to the printhead slot 14. More particularly, when the end portion 20 of the first tubing 16 is in the active position, a fluid interconnect may connect the first tubing 16 with a corresponding tubing of a printhead, when the printhead is mounted to the printhead slot 14.

The second tubing 18 may also comprise an end portion 22. As shown in FIG. 1A, the end portion 22 of the second tubing 18 may be in a standby position, i.e., a position in which no printing fluid is provided to a printhead via the second tubing 18. In particular, the standby position may be a position in which no printhead of printing apparatus 10 is provided with printing fluid via the second tubing 18.

As shown in FIG. 1B, the end portion 20 of the first tubing 16 may be moved to a standby position and the end portion 22 of the second tubing 18 may be moved to an active position. In particular, the end portion 22 of the second tubing 18 may be moved to the active position that was previously occupied by the end portion 20 of the first tubing 16. Heretofore, the printing apparatus 10 may comprise a mechanical structure 24 to which the end portion 20 of the first tubing 16 is attached. In particular, the mechanical structure 24 may allow to remove the end portion 20 of the first tubing 16 from the active position and to arrange the end portion 22 of the second tubing 18 in the active position. As shown in FIGS. 1A and 1B, the mechanical structure 24 may be attached to the support member 12.

To allow for smooth operation, the first tubing 16 may be made of a flexible material and be provided with an increased length to avoid forces counteracting the transition of the end portion 20 of the first tubing 16 between its active position and its standby position. Likewise, the second tubing 18 may also be made of a flexible material and be provided with an increased length to avoid forces counteracting the transition of the end portion 22 of the second tubing 18 between its active position and its standby position. Moreover, the mechanical means may be adapted to cut-off, during transition between active and standby position and/or as long as no printhead is mounted to the printhead slot 14, a fluid connection to an end portion 20, 22 of a tubing 16, 18 to avoid printing fluid loss.

Figure 2:
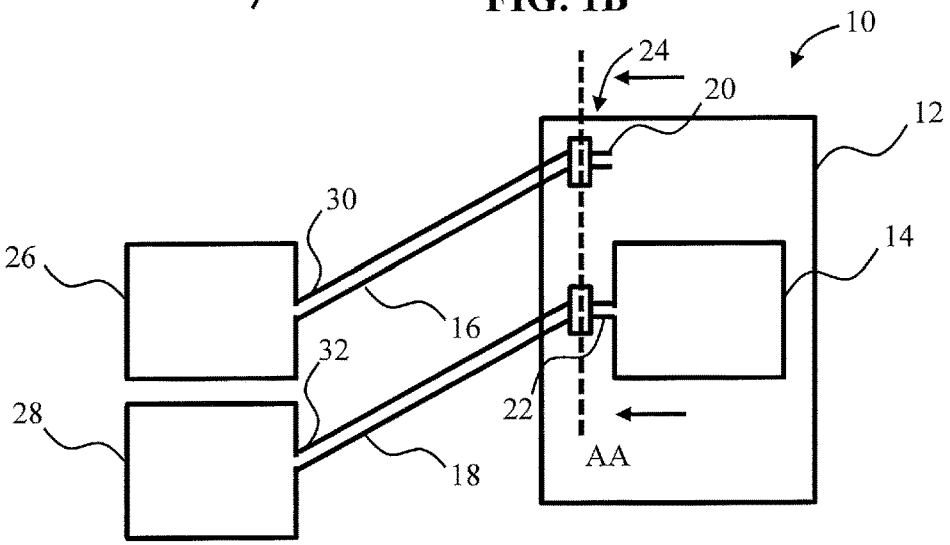
FIG. 2 shows a schematic cross-sectional view of examples of further elements of the printing apparatus.

As shown in FIG. 2, the printing apparatus 10 may further comprise a first printing fluid cartridge slot 26 and a second printing fluid cartridge slot 28. The first tubing 16 may receive the first printing fluid from a first printing fluid cartridge (not shown) mounted to the first printing fluid cartridge slot 26 and the second tubing 18 may receive the second printing fluid from a second printing fluid cartridge (not shown) mounted to the second printing fluid cartridge slot 28. I.e., a cartridge-side end portion 30 of the first tubing 16 may be fixed to the first printing fluid cartridge slot 26 and a cartridge-side end portion 32 of the second tubing 18 may be fixed to the second printing fluid cartridge slot 28.

Furthermore, the cartridge-side end portion 30 of the first tubing 16 and the cartridge-side end portion 32 of the second tubing 18 may switch between an active position and a standby position (and vice versa) in relation to the first printing fluid cartridge slot 26 analogously to the printhead-side end portion 20 of the first tubing 16 and the printhead-side end portion 22 of the second tubing 18, respectively, described above and further detailed in the following.

In particular, the cartridge-side end portion 30 of the first tubing 16 and the cartridge-side end portion 32 of the second tubing 18 may be attached or coupled to the mechanical structure 24. The coupling may be such that upon moving the printhead-side end portion 22 of the second tubing 18 to the printhead-side active position, the cartridge-side end portion 32 of the second tubing 18 is moved to the cartridge-side active position, while the end portions 20 and 30 of the first tubing 16 are moved to their standby positions.

Figure 3A:
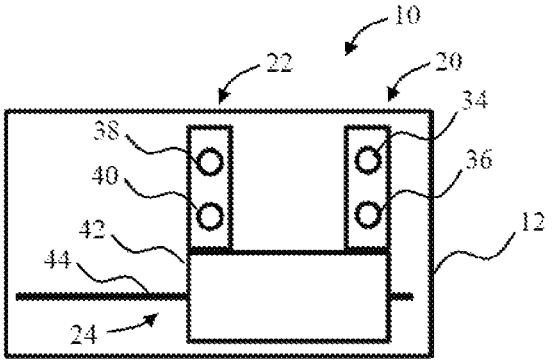
FIGS. 3A, 3B, and 3C show schematic cross-sectional views of examples of mechanical structures within the printing apparatus.
Figure 3B:
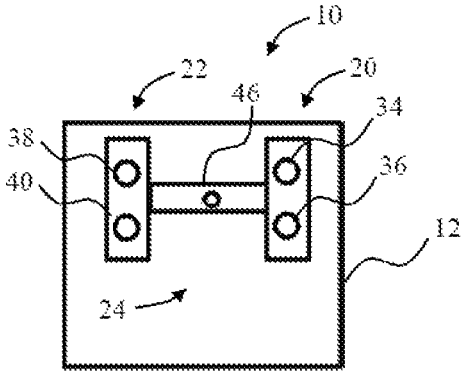
Figure 3C:
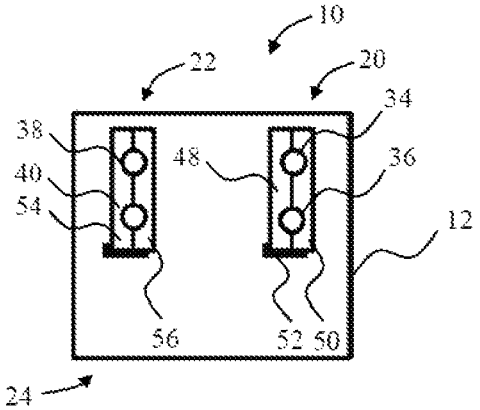

The end portions 20 and 30 of the first tubing 16 and the end portions 22 and 32 of the second tubing 18 may each comprise one tube ending. Furthermore, as shown in FIGS. 3A to 3C which show a schematic cross-sectional view along line AA of FIG. 2, the printhead-side end portion 20 of the first tubing 16 and the printhead-side end portion 22 of the second tubing 18 may each comprise two tube endings 34-38, e.g., for recirculation. Moreover, the first tubing 16 and the second tubing 18 may be coupled to pumps (not shown) for conveying the printing fluid. Each tube ending 34-38 may be provided with a particular shape to avoid that a printhead intended for a particular color is inadvertently connected to a tube ending of a tubing intended for another color.

As shown in FIG. 3A, the mechanical structure 24 may comprise a skid 42 to which the printhead-side end portion 20 of the first tubing 16 and the printhead-side end portion 22 of the second tubing 18 are attached. Furthermore, the support member 12 may comprise a guide pillar 44 for guiding a displacement of the skid 42 relative to the support member 12. The skid 42 and the guide pillar 44 may be provided with a notch and a corresponding protrusion, respectively, for keeping the skid 42 in a first position in which the printhead-side end portion 20 of the first tubing 16 is in the active position and in a second position in which the printhead-side end portion 22 of the second tubing 16 is in the active position.

As shown in FIG. 3B, the mechanical structure 24 may comprise a pivot member 46 which is pivotally coupled to the support member 12 and to which the printhead-side end portion 20 of the first tubing 16 and the printhead-side end portion 22 of the second tubing 18 are attached. The pivot member 46 may be arranged to rotate around an axis through a center of the tube endings 34-38 so that upon a 180° rotation of the pivot member, the printhead-side end portion 20 of the first tubing 16 and the printhead-side end portion 22 of the second tubing 18 switch positions. When the printhead-side end portion 20 of the first tubing 16 and the printhead-side end portion 22 of the second tubing 18 switch positions, the tube endings 34 and 36 of the first tubing 16 and the tube endings 38 and 40 of the second tubing 18 may switch positions.

As shown in FIG. 3C, the mechanical structure 24 may comprise a base portion 48 and a locking portion 50, wherein the locking portion 50 may lock the printhead-side end portion 20 of the first tubing 16 to the base portion 48. The locking portion 50 may comprise a hook 52 that snaps past a side of the base portion 48 opposite to the locking portion 50 to secure the printhead-side end portion 20 of the first tubing 16 to the base portion 48. For unlocking the printhead-side end portion 20 of the first tubing 16 from the base portion 48, the hook 52 may be made of a resilient material that allows detaching the hook 52 from the base portion 48. Once unlocked, the printhead-side end portion 20 of the first tubing 16 may be removed from the active position and the printhead-side end portion 22 of the second tubing 18 may be arranged in the active position.

To prevent loss of the locking portion when the hook 52 of the locking portion 50 is detached from the base portion 48, the base portion 48 and the locking portion 50 may be coupled by a hinge. Instead or in addition to the hinge, the locking portion 50 may be provided with a further hook (not shown) similar or identical to hook 52 so that the locking portion 50 is provided with two hooks 52 that snap past the side of the base portion 48 opposite to the locking portion 50 when the printhead-side end portion 20 of the first tubing 16 or the printhead-side end portion 22 of the second tubing 18 are locked to the base portion 48.

The mechanical structure 24 may further comprise another base portion 54 and another locking portion 56 identical or similar to the above described base portion 48 and locking portion 50 to keep the printhead-side end portion 20 of the first tubing 16 and the printhead-side end portion 22 of the second tubing 18, respectively, in a standby position.

Figure 4:
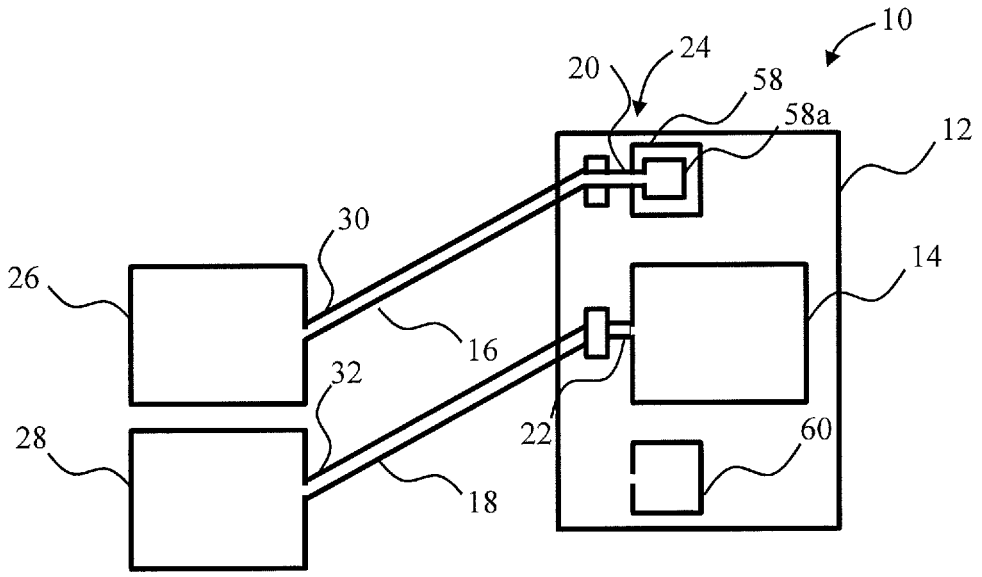
FIG. 4 shows a schematic cross-sectional view of examples of further elements of the printing apparatus.
Figure 5:
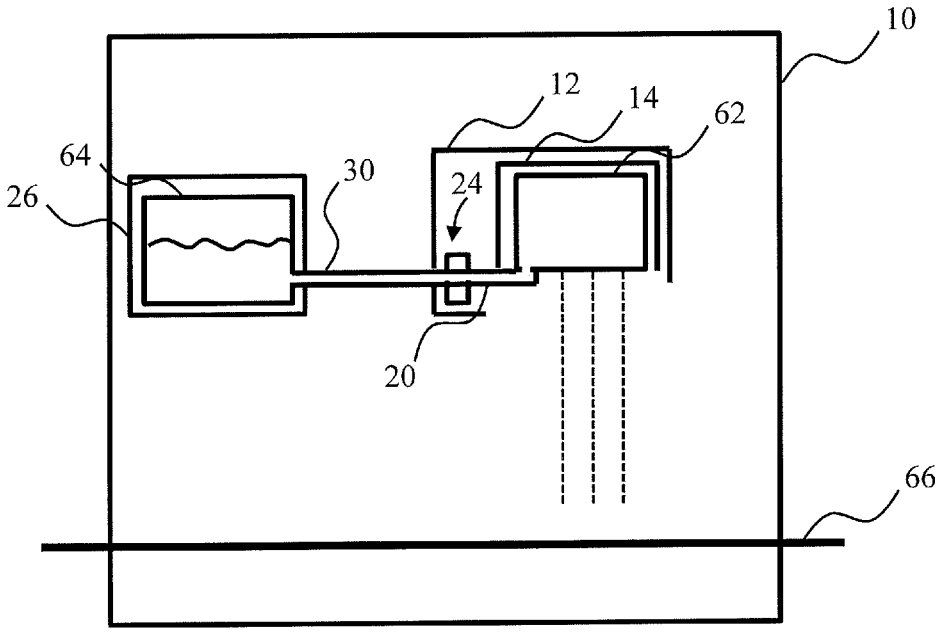
FIG. 5 shows a schematic cross-sectional view of examples of further elements of the printing apparatus.

As shown in FIG. 4, the printhead-side end portion 20 of the first tubing 16 may be coupled to a standby unit 58, when in the standby position. The standby unit 58 may comprise an end portion cover to cover the printhead-side end portion 20 of the first tubing 16 to avoid, for example, drying out of a printing fluid in the first tubing 16. Furthermore, the standby unit 58 may comprise a recirculation unit 58*a* for recirculating the printing fluid in the first tubing 16 to avoid, for example, clogging of the first printing fluid.

Furthermore, the printing apparatus 10 may comprise another standby unit 60, similar or identical to the standby unit 58 to which the printhead-side end portion 22 of the second tubing 16 may be coupled. To avoid mixing of printing fluids, the examples of the mechanical structure 24 shown in FIGS. 3B and 3C may be amended to allow for different standby positions for the printhead-side end portion 20 of the first tubing 16 and the printhead-side end portion 22 of the second tubing 18.

The printing apparatus 10 may further comprise a printhead 62 mounted to the printhead slot 14. The printhead 62 may be provided with printing fluid by a printing fluid reservoir 64 such as a printing fluid tank or a printing fluid cartridge inserted into the printing fluid cartridge slot 26. The provided printing fluid may then be printed, by the printhead 62, onto a print medium which is conveyed by a print medium conveyor of the printing apparatus 10 along a print medium feed path 66 through the printing apparatus 10.

Figure 6:
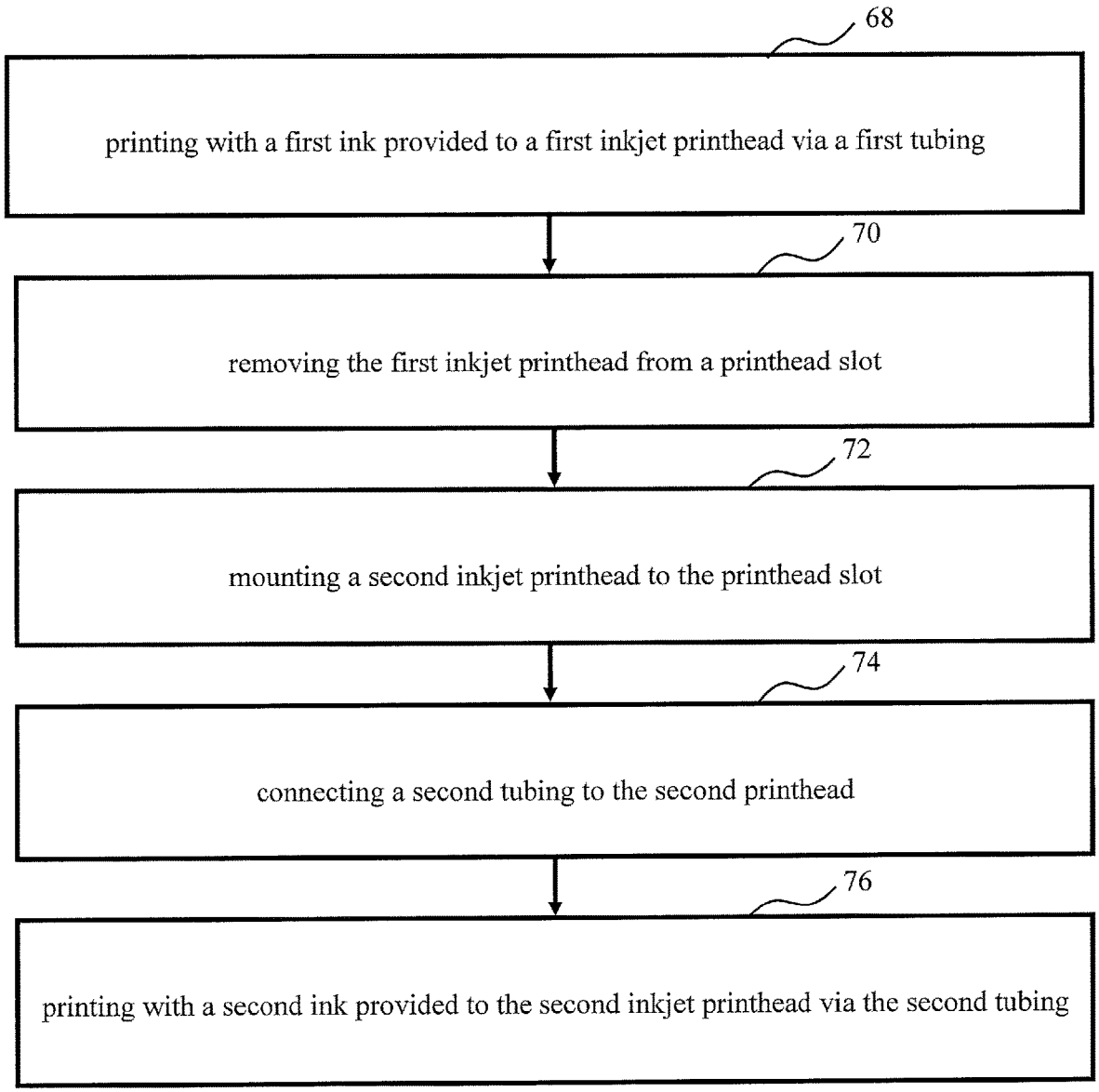
FIG. 6 shows a flow diagram of an example of a process of replacing an inkjet printhead in the printing apparatus.

FIG. 6 shows a flow diagram of an example of a process of replacing an inkjet printhead such as, for example, the inkjet printhead 62 of printing apparatus 10. At 68, the process starts with printing on a printing medium with a first ink provided to the first inkjet printhead 62 via the first tubing 16. At 70, the process continues with removing the first inkjet printhead 62 from the printhead slot 14. At 72, the process continues with mounting a second inkjet printhead to the printhead slot 14. At 74, the process continues with connecting the second tubing 18 to the second printhead. At 76, the process continues with printing on a printing medium with a second ink provided to the second inkjet printhead via the second tubing 18. During the whole procedure, a portion of the first tubing 16 and a portion of the second tubing 18 are attached to the printing apparatus 10.

After having, for example, completed a printjob for a particular color gamut, the first printhead 62 may be reinstalled. Heretofore, the process my continue with removing the second inkjet printhead from the printhead slot 14, mounting the first inkjet printhead 62 to the printhead slot, connecting the first tubing 16 to the first printhead 62, and printing the first ink provided to the first inkjet printhead 62 via the first tubing 16. As the end portions 20 and 22 of the tubings 16 and 18 may be switched between active and standby positions as described above, a portion of the first tubing 16 and a portion of the second tubing 18 may remain attached to the printing apparatus 10 during the whole procedure, thereby avoiding the need to detach a tubing 16, 18 and to attach another tubing to the printing apparatus 10.

Moreover, the second inkjet printhead may be replaced with a third inkjet printhead, for example, when the first printhead is outworn and is to be replaced. Heretofore, the process may continue with removing the second inkjet printhead from the printhead slot 14, mounting the third inkjet printhead to the printhead slot 14, connecting the first tubing 16 to the third printhead, and printing on a printing medium with the first ink delivered to the third inkjet printhead via the first tubing 16. As described above, a portion of the first tubing 16 and a portion of the second tubing 18 may remain attached to the printing apparatus 10 during the whole procedure.

To avoid clogging of printing fluid in the first tubing 16 when the first tubing 16 is disconnected, the process may continue with connecting the first tubing 16 to the recirculating unit 58*a* to recirculate the first ink in the first tubing 16.

LIST OF REFERENCE SIGNS

10 printing apparatus
12 support member
14 printhead slot
16 tubing
18 tubing
20 tubing end portion
22 tubing end portion
24 mechanical structure
26 printing fluid cartridge slot
28 printing fluid cartridge slot
30 tubing end portion
32 tubing end portion
34 tube ending
36 tube ending
38 tube ending
40 tube ending
42 skid
44 guide pillar
46 pivot member
48 base portion
50 locking portion
52 hook
54 base portion
56 locking portion
58 standby unit
58*a* recirculation unit
60 standby unit
62 printhead
64 printing fluid reservoir
66 print medium feed path
68-76 process steps

The invention claimed is:

1. A printing apparatus, comprising:
a support member having a printhead slot;
a first printing fluid tubing comprising a printhead-side end portion;
a second printing fluid tubing comprising a printhead-side end portion;
wherein the printhead-side end portion of the first tubing and the printhead-side end portion of the second tubing are to be placed in:
an active position in which the corresponding printhead-side end portion is in fluid communication with a printhead in the printhead slot; and
a standby position in which the corresponding printhead-side end portion is not in fluid communication with a printhead in the printhead slot; and
a mechanical structure coupled to the first printing fluid tubing and the second printing fluid tubing, wherein the mechanical structure is actuatable between:
a first position to place the printhead-side end portion of the second printing fluid tubing into the active position and to place the printhead-side end portion of the first printing fluid tubing into the standby position; and
a second position to place the printhead-side end portion of the first printing fluid tubing into the active position and to place the printhead-side end portion of the second printing fluid tubing into the standby position.

2. The printing apparatus of claim 1, the apparatus further comprising:
a first printing fluid cartridge slot; and
a second printing fluid cartridge slot;
wherein the first printing fluid tubing is arranged to receive a first printing fluid from a first printing fluid cartridge in the first printing fluid cartridge slot; and
wherein the second printing fluid tubing is arranged to receive a second printing fluid from a second printing fluid cartridge in the second printing fluid cartridge slot.

3. The printing apparatus of claim 1, wherein the printhead-side end portion of the first printing fluid tubing comprises two tube endings and wherein the printhead-side end portion of the second printing fluid tubing comprises two tube endings.

4. The printing apparatus of claim 3, the apparatus further comprising a recirculation unit, wherein the printhead-side end portion of the first printing fluid tubing is connected to the recirculation unit when the printhead-side end portion of the first printing fluid tubing is in the standby position, and wherein the printhead-side end portion of the second printing fluid tubing is connected to the recirculation unit when the printhead-side end portion of the second printing fluid tubing is in the standby position.

5. The printing apparatus of claim 1, the apparatus further comprising an end portion cover, wherein the printhead-side end portion of the first printing fluid tubing is covered by the end portion cover when the printhead-side end portion of the first printing fluid tubing is in the standby position, and wherein the printhead-side end portion of the second printing fluid tubing is covered by the end portion cover when the printhead-side end portion of the second printing fluid tubing is in the standby position.

6. The printing apparatus of claim 1, wherein the mechanical structure comprises a skid to which the printhead-side end portion of the first printing fluid tubing and the printhead-side end portion of the second printing fluid tubing are attached, wherein the support member comprises a guide pillar for guiding a displacement of the skid relative to the support member, and wherein the skid is to be displaced along the guide pillar between:

a first position in which the printhead-side end portion of the first printing fluid tubing is in the active position and the printhead-side end portion of the second printing fluid tubing is in the standby position; and a second position in which the printhead-side end portion of the second printing fluid tubing is in the active position and the printhead-side end portion of the first printing fluid tubing is in the standby position.

7. The printing apparatus of claim 1, wherein the mechanical structure comprises a pivot member which is pivotally coupled to the support member and to which the printhead-side end portion of the first printing fluid tubing and the printhead-side end portion of the second printing fluid tubing are attached, and wherein the pivot member is pivotable relative to the support member between:

a first position in which the printhead-side end portion of the first printing fluid tubing is in the active position and the printhead-side end portion of the second printing fluid tubing is in the standby position; and a second position in which the printhead-side end portion of the second printing fluid tubing is in the active position and the printhead-side end portion of the first printing fluid tubing is in the standby position.

8. The printing apparatus of claim 1, wherein the mechanical structure comprises a base portion and a locking portion, wherein the locking portion locks the printhead-side end portion of the first printing fluid tubing to the base portion when in a first position, and unlocks the printhead-side end portion of the first printing fluid tubing from the base portion when in a second position.

9. The printing apparatus of claim 2, wherein the printing apparatus is an inkjet printing apparatus and wherein the first printing fluid is a first ink and wherein the second printing fluid is a second ink.

10. The printing apparatus of claim 9, wherein the first ink and the second ink are different inks.

11. The printing apparatus of claim 10, wherein the first ink and the second ink are inks of different colors.

12. The printing apparatus of claim 1, wherein the printhead-side end portion of the first printing fluid tubing has a different shape than the printhead-side end portion of the second printing fluid tubing.

13. The printing apparatus of claim 12, further comprising a printing fluid cartridge in the printhead slot and wherein the different shape of the printhead-side end portion obviates connecting the second printing fluid tubing with the printing fluid cartridge.

* * * * *